United States Patent [19]

Kuroda et al.

[11] Patent Number: 5,069,029

[45] Date of Patent: Dec. 3, 1991

[54] GAS TURBINE COMBUSTOR AND COMBUSTION METHOD THEREFOR

[75] Inventors: Michio Kuroda; Seiichi Kirikami; Katsukuni Hisano; Nobuyuki Iizuka; Haruo Urushidani; Isao Sato; Yoji Ishibashi; Takashi Ohmori, all of Hitachi, Japan

[73] Assignee: Hitachi, Ltd., Tokyo, Japan

[21] Appl. No.: 563,191

[22] Filed: Aug. 6, 1990

Related U.S. Application Data

[63] Continuation of Ser. No. 163,376, Mar. 2, 1988, abandoned.

[30] Foreign Application Priority Data

Mar. 5, 1987 [JP] Japan ..... 62-50060

[51] Int. Cl.[5] ..... F02C 3/14; F23R 3/32

[52] U.S. Cl. ..... 60/39.06; 60/39.29; 60/733; 60/737

[58] Field of Search ..... 60/732, 733, 737, 748, 60/39.29, 39.06

[56] References Cited

U.S. PATENT DOCUMENTS 3,859,787 1/1975 Anderson et al. ..... 60/737

4,138,842 2/1979 Zwick ..... 60/737

FOREIGN PATENT DOCUMENTS 894054 4/1962 United Kingdom ..... 60/748

2146425 4/1985 United Kingdom ..... 60/732

*Primary Examiner*—Richard A. Bertsch

*Assistant Examiner*—Timothy S. Thorpe

*Attorney, Agent, or Firm*—Antonelli, Terry, Stout & Kraus

[57] ABSTRACT

A gas turbine combustor comprising a head combustion chamber and a rear combustion chamber connected to a downstream side of the head combustion chamber, a first stage burner for premixing first stage fuel and air and supplying the resultant fuel and air premixture into the head combustion chamber to effect first stage premix combution, a second stage burner for premixing second stage fuel and air and the resultant fuel and air premixture into the rear combustion chamber to effect premix combustion in addition to the first stage premix combustion, and a device for regulating flow rates of combustion air to be premixed with first and second stage fuel. The combustor is further provided with a pilot burner in the head combustion chamber to form pilot flame and stabilize the first stage premix combustion.

23 Claims, 5 Drawing Sheets

GAS TURBINE COMBUSTOR AND COMBUSTION METHOD THEREFOR

This is a continuation of application Ser. No. 163,376, filed Mar. 2, 1988 now abandoned.

BACKGROUND OF THE INVENTION

The present invention relates to a combuster for an industrial gas turbine and, more particularly, to a multi-stage combustion type combustor providing a low nitrogen oxides ($NO_x$) concentration in an exhaust gas.

As an example of conventional combustors, FIG. 1 of European Patent Publication No. 0 169 431 illustrates a two-stage combustion type combustor, wherein the $NO_x$ concentration in an exhaust gas of this combustor is lower than in a single-stage combustion type combustor. Additionally, FIG. 1 of U.S. Pat. No. 4,112,676 illustrates an example of a combustor providing diffusion combustion while controlling the flow rate of a fuel and multi-stage premix combustion on a downstream side thereof.

Recently, for environmental protection extremely strict regulations for the emission of $NO_x$ have been proposed and such regulations cannot be satisfied by merely employing conventional systems such as described above. Therefore, a more precise control of a combustion phenomenon is necessary.

Of the two conventional systems referenced above, the former proposal reduces the $NO_x$ concentration by a combination of diffusion combustion and premix combustion. However, since diffusion combustion is partially used, the occurrence of hot spots is unavoidable. In order to further reduce the $NO_x$ concentration, an improvement in the diffusion combustion process is necessary.

The latter proposal employs multi-stage premix combustion on the downstream side, but since the diffusion combustion system is employed at the head portion, there is an inevitable limit to the reduction of the $NO_x$ concentration; therefore, practical problems will develop.

Japanese Patent Laid-Open No. 57-41524/1982 discloses a gas turbine in which a premixing chamber is provided outside the combustor for premixing fuel with air that an air from a compressor is boosted up and supplies the resultant premixture into a combustion chamber at a head portion to form a pilot flame, and premixed fuel and air is further supplied on a downstream side thereof for main combustion.

SUMMARY OF THE INVENTION

It is therefore an object of the present invention to provide a premixing multi-stage combustor which econimically minimizes the occurrence of $NO_x$ inside the combustor and moreover, can stably carry out combustion within an opertional range of the combustor.

In a combustor of the type wherein fuels are supplied into a head combustion chamber and a rear combustion chamber and combustion is effected at multiple stages, the object described above can be accomplished by mixing in advance both of the fuels supplied to the head and rear combustion chambers with combustion air regulated in flow rate so as to strengthen the degree of premixing and to carry out multistage lean premix combustion.

DETAILED DESCRIPTION OF THE INVENTION

Figure 7:
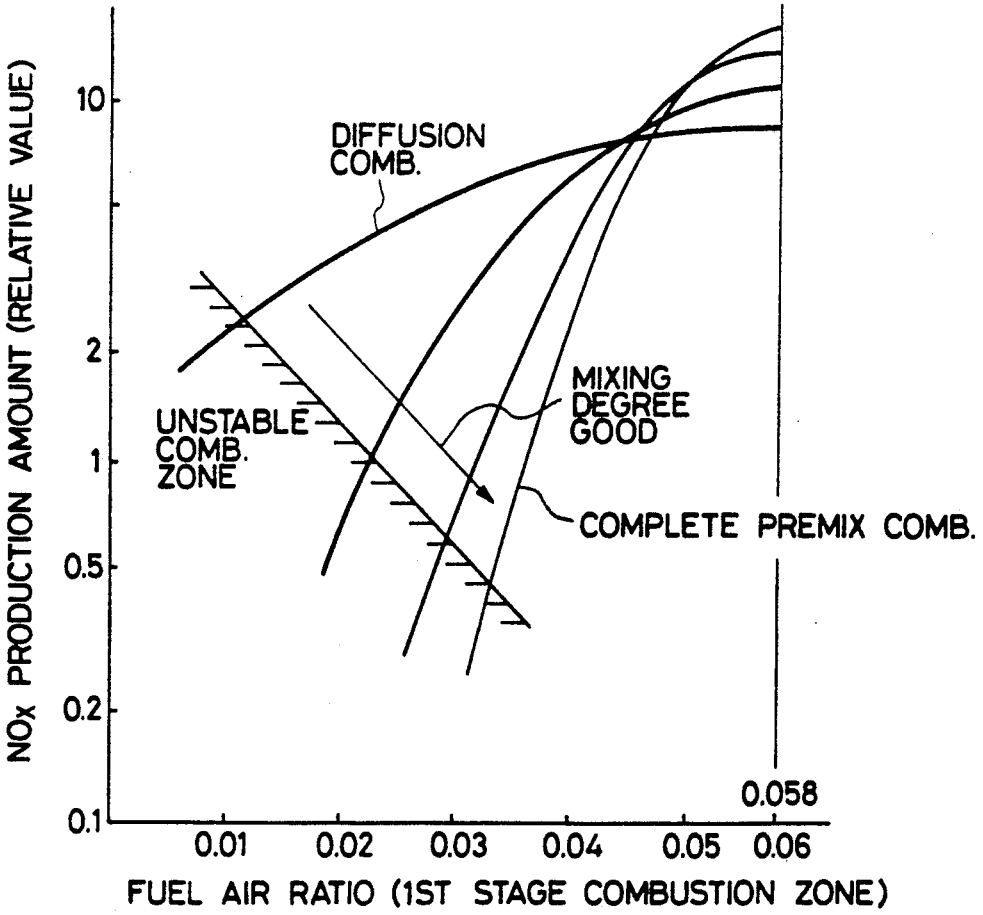
FIG. 7 is a diagram illustrating a relationship between a combustion type and a quantity of resulting $NO_x$.

The combustion phenomenon can be classified broadly into diffusion combustion and premix combustion. The generation quantity of $NO_x$ in these combustors is generally such as shown in FIG. 7. It can be understood that lean combustion must be made in order to restrict the generation quantity of $NO_x$. The $NO_x$ concentration can be more reduced with an increasing degree of premixing if the fuel-air ratio is kept constant, while $NO_x$ concentration increases drastically with increasing fuel air ratio even if premixing is sufficiently effected. From stability of combustion, however, the stable range of the fuel-air ratio becomes narrower with the increasing degree of premixing.

On the other hand, one of characterizing features of gas turbine combustors lies in that the operation range of the fuel-air ratio from the start to the rated load is extremely wide. Particularly at the time of the load operation of the gas turbine, the operation is made by adjusting only the fuel flow rate under the condition that the air quantity is substantially constant. For this reason, the fuel quantity becomes small at the time of a low load operation to establish a lean state and there is the danger that unburnt components increase and dynamic pressure increases thereby causing oscillation.

Figure 8:
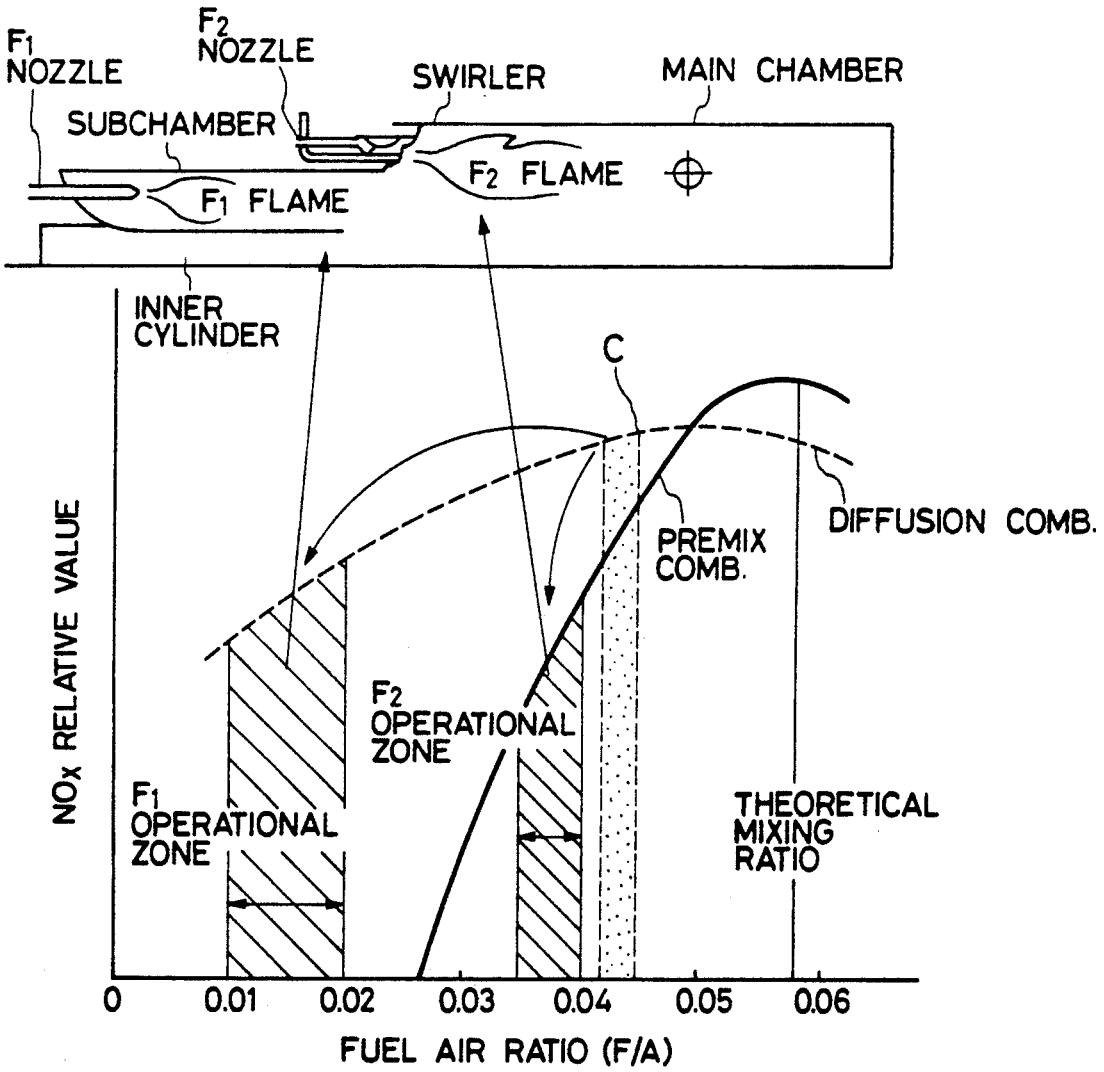
FIG. 8 PRIOR ART
FIG. 8 is a characteristic diagram showing conventional first stage and second stage combustion conditions.

Taking the problems described above into consideration, European Patent Publication No. 0 169 431 proposes a system which employs diffusion combustion having a wide stable combustion range at the start and the low load operation, adds premix combustion at the time of the high load operation and thus reduces the $NO_x$ concentration. FIG. 8 shows the operation zones of first stage and second stage nozzles ($F_1$, $F_2$). In other words, it employs the combination of diffusion combustion using lean combustion ($F_1$ operational zone) and premix combustion ($F_2$ operational zone), and the conventional combustor was improved from a combustion system using diffusion combustion alone, which operational zone is shown by C, in order to reduce the $NO_x$ concentration.

To further reduce the $NO_x$ concentration, the degree of premixing must be further improved. In other words, reduction of $NO_x$ can be accomplished by employing premixing for the first stage combustion, improving the degree of premixing, inclusive of that of the second stage and effecting lean combustion.

The factors that might become necessary when premixing is improved are counter-measures for narrowness of the stable combustion range, the structure and controlling method for effecting combustion under the condition approximate to the optimal condition throughout the full operation range, and the structure for improving premixing.

A stable combustion range is made sufficiently wide by providing a pilot flame particularly at the time of low load so as to permit a premixed fuel combustion flame burn stably. To effect combustion under the condition approximate to the optimal condition throughout the full operation range, the air-fuel ratio cannot be controlled at only one stage due to the limitation of an actual machine, so that two stage combustion is employed and the fuel-air ratio is controlled at each stage. The structure for improving premixing can be accomplished by employing a structure wherein a premixing distance is sufficiently lengthened.

Hereinafter, one embodiment of the present invention will be described with reference to FIG. 1 wherein a combustor 15 includes a combustor liner 3 comprising portions of a main chamber 1 or rear combustion chamber and a sub-chamber 2 or head combustion chamber disposed in an outer cylinder 4.

The combustor is of a multi-stage combustion type wherein a pilot burner 5, a first stage burner 6 and a second stage burner 7 are provided. The first stage burner annular 6 comprises a pilot burner partition 19 fixed to an end plate 4*a* of the outer cylinder 4. The annular partition 19 is fixed to an annular member 21*a* with an annular space therebetween, a plurality of swirler vanes are 21 disposed between and fixed to the annular member 21*a* and the partition 19 thereby providing a plurality of outlets for premixed fuel and air, and a plurality of first stage fuel nozzles 20 are provided with the tips thereof being disposed on more upper reaches than the upperstream side of the swirler vanes 21 so that a sufficient length for premixing fuel and air is obtained. The plurality of outlets of the first stage burner 6 are annularly arranged adjacent to the inner surface of the sub-chamber 2 and surround the pilot burner 5 disposed at a central axis of the sub-chamber 2. The pilot burner 5 has a swirler made of a plurality of swirler vanes 21 and surrounding a central fuel nozzle. The pilot burner 5 is supplied with combustion air from a line 14*a* branched from a compressed air line 14.

The second stage burner 7 is slidably disposed between an outer surface of a downstream end of the sub-chamber 2 and an inner surface of an upstream end of the main chamber 1. The second stage burner 7 comprises an inner annular member 27*b*, an outer annular member 27*a*, a plurality of swirler vanes 23 secured thereto thereby providing a plurality of outlets for premixed fuel and air, and a plurality of second stage fuel nozzles 22 the tips of which are disposed on more upper reaches than the swirler vanes 23, so that a sufficient length for premixing fuel and air is obtained. An inlet side of the second stage burner 7 is secured to a partition 8 secured to the outer cylinder 4, with the partition 8 having a plurality of air holes 26 communicating with the inlet of the first stage burner 6. A guide ring 9, having a plurality of air holes 25, surrounds the air holes of the partition 8 and the inlet of the second stage burner 7 and is axially movable so as to control flow rates of combustion air to the first and second stage burners 6, 7.

The outer cylinder 4, guide ring 9, the partition 8 and the outer surface of the main chamber 1 define an annular space for air passage communicating with the compressed air line 14. Combustion air to be introduced into the first stage and second stage burners 6, 7 is separated by the partition 8 and the quantity of inflowing air is controlled by the guide ring 9. The fuel is dividedly supplied as a pilot burner fuel 10, a first stage burner fuel 11 and a second stage burner fuel 12.

The air leaving a compressor portion 13 of a gas turbine 16 is introduced into the combustor 15 through the line 14 and turned to high temperature gas by the combustor 15 and rotates a dynamo 17 at the turbine portion 16 to produce electric power.

At the start, the pilot burner fuel 10 is first supplied to the pilot burner 5 to cause a diffusion combustion. The fuel is supplied from the center portion and causes combustion by combustion air from the swirler 18 for the pilot burner. This pilot burner 5 generates a stable flame in the sub-chamber 2 and power at the time of start in the gas turbine, and plays the role of the flame for burning stably the premix combustion flame generated by the first stage burner 6. In this embodiment, the combustion air for pilot burner 5 enters the space 19*a* which is completely partitioned by the partition 19 and the combustion air for first stage burner 6, which quantity is controlled, enters the outside of the space 19*a*. Therefore, this structure is one that controls completely the combustion air for the first stage burner 6 rather than for the pilot burner 5.

The first stage burner 6, is provided with the nozzles 20 each having a tip disposed upstream of a fuel-air mixture outlet of the swirler vanes 21 and the fuel is swirled by the swirler vanes 21 after reaching the premixed state and is supplied into and combusted inside the sub-chamber 2.

At a time of low load operation of the turbine, a first stage fuel is supplied into the sub-chamber 2 through the first stage burner 6 with the combustion air being regulated by an air flow rate regulating device described herein below fired by the pilot flame. As the first stage fuel increases, the combustion air is increased by the air flow rate regulating device so that lean combustion can be effected.

Since this flame is premix combustion flame controlled in flow rate of combustion air so as to effect lean combustion, the range of stable combustion becomes generally narrow but since the fuel is swirled by the swirler vanes 21 and the flame is stably maintained by the pilot burner 5, a stable combustion can be obtained with a low $NO_x$ concentration.

The second stage burner 7, independent of the first stage burner 6, is disposed downstream of the first stage burner 6 and effects stable premix combustion with a low $NO_x$ concentration in the main chamber 1. Ignition in this case is made by the flame generated in the sub-chamber 2.

To control the fuel-air ratio, the air flow rate must be controlled in response to the increase of the fuel that occurs with the increase of the load. The control is effected by the above-mentioned air flow rate regulating device. Namely, the device comprises the guide ring 9 and the guide ring moving mechanism 24, with the guide ring 9 being movable in the axial direction by the guide ring moving mechanism 24. A plurality of air supply holes 25 are bored in the guide ring 9 and the air can inflow from the portions which can communicate with a partition air introduction hole 26 disposed on the partition 8 and a second stage burner air introduction portion 27. The area of this communication portion can be increased and decreased with the movement of the guide ring 9 in the axial direction. In other words, the air inflowing from the partition air introduction holes 26 is used as the combustion air for the first stage burner 6 and the air from the second burner air introduction holes 27 is used as the combustion air for the second stage burner 7. According to the structure described above, the air-fuel ratio of the first and second stage burners 6, 7 can be suitably controlled and low $NO_x$ concentration can be accomplished.

Figure 2:
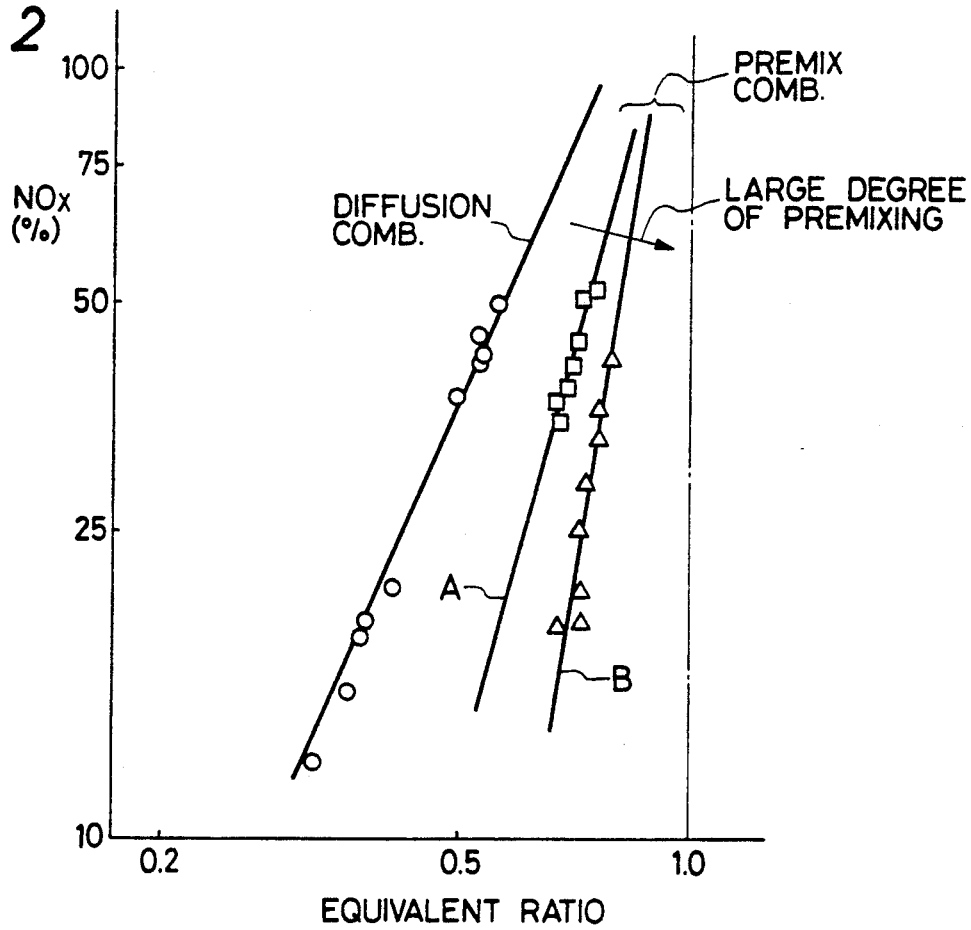
FIG. 2 is a diagram showing the result of measurement of $NO_x$ in premix combustion.

FIG. 2 shows an example of the result of measurement of $NO_x$ of premix combustion. More particularly, FIG. 2 illustrates the $NO_x$ value corresponding to the equivalent ratio of fuel to combustion air where a multi-diffusion combustion nozzle is used for the first stage burner 6 and a premix combustion nozzle is used for the second stage burner 7. Two lines A and B in premix combustion represent the results of two cases A and B wherein different structures of the second stage burner 7 are employed. The rightward line which is large in a gradient exhibits a larger degree of premixing. Since the ratio of the air flow rate to the fuel is substantially constant in the gas turbine, the $NO_x$ must be as low as possible with respect to a certain equivalent ratio. From this respect, an effective system is one that increases the premixing degree as much as possible but does not provide a high $NO_x$ value even when combustion is made at a high equivalent ratio.

In other words, it is extremely effective to employ premix combustion for the first and second stage burners 6, 7 and to reduce the diffusion combustion portion as much as possible.

According to the invention, an amount of fuel can be stably combusted under a state of lean fuel because the combustion air flow rate is regulated to be a suitable fuel air premixture. Therefore, as the turbine comes into a high load operation, an amount of combustion air is increased in addition to increase in fuel amount. In this control, excess combustion air in the annular space enters the combustor through dilution holes (not shown) made in the combustor liner 3, so that even if the turbine load changes, the stable lean combustion is effected.

Figure 3:
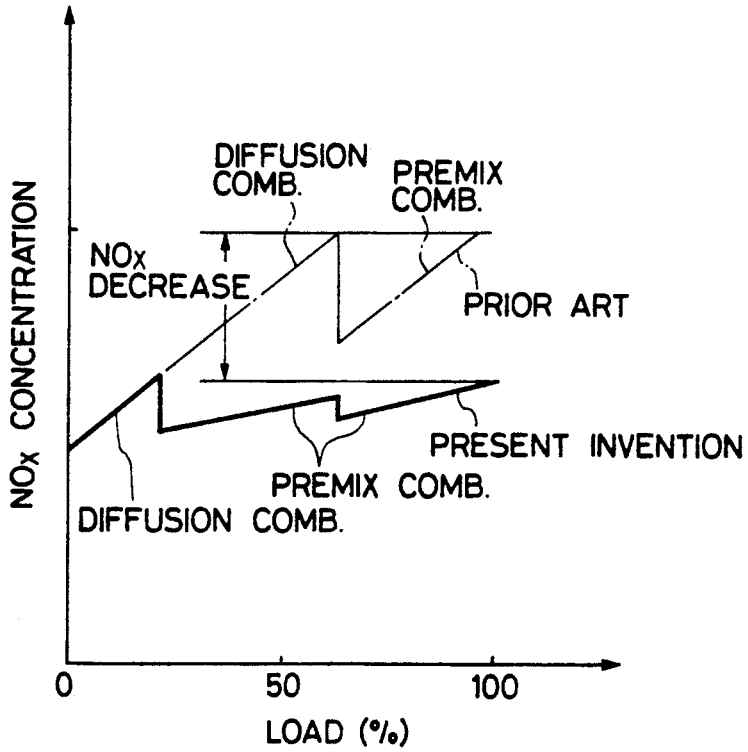
FIG. 3 is a diagram illustrating a relationship between $NO_x$ and a gas turbine load.

FIG. 3 shows the estimated relationship between $NO_x$ and the gas turbine load when combustion is effected as described above. The prior art example represents the case where the first stage burner employs diffusion combustion and the second stage burner employs premix combustion. In the case of the present invention, suitable premix combustion is made by reducing the diffusion combustion portion as much as possible and increase the premixing degree at the first and second stage burners. As a result, premix combustion with a substantially constant equivalent ratio can be made by controlling suitably the fuel-air ratio, and $NO_x$ can be reduced drastically in comparison with the prior art example.

The examples shown in FIG. 3 are of the two-stage type. $NO_x$ concentration drops in the step-like form at the point of shift from diffusion combustion to premix combustion and at about intermediate point of premix combustion. This happens when the first stage burner 6 and the second stage burner 7 are sequentially ignited.

When the flame is shifted from the pilot burner 5 to the first stage burner 6 and further to the second stage burner 7, the fuel-air ratio must be optimized and set to a suitable value that the shift of flame reliably occurs. For there is the danger of occurrence of unburnt components if firing is not quickly effected, but the flame can be shifted stably by premix combustion and moreover, by controlling the fuel-air ratio. The gradient of the increase of $NO_x$ during the switch of the burners is determined by the proportion of diffusion combustion to the entire combustion and the conditions at the time of switch of the burners.

Such operation conditions can be controlled in detail by controlling the fuel-air ratio as in the present invention. Namely, the present invention is characterized in that $NO_x$ can be reduced by suitably controlling the combustion phenomenon itself.

Figure 1:
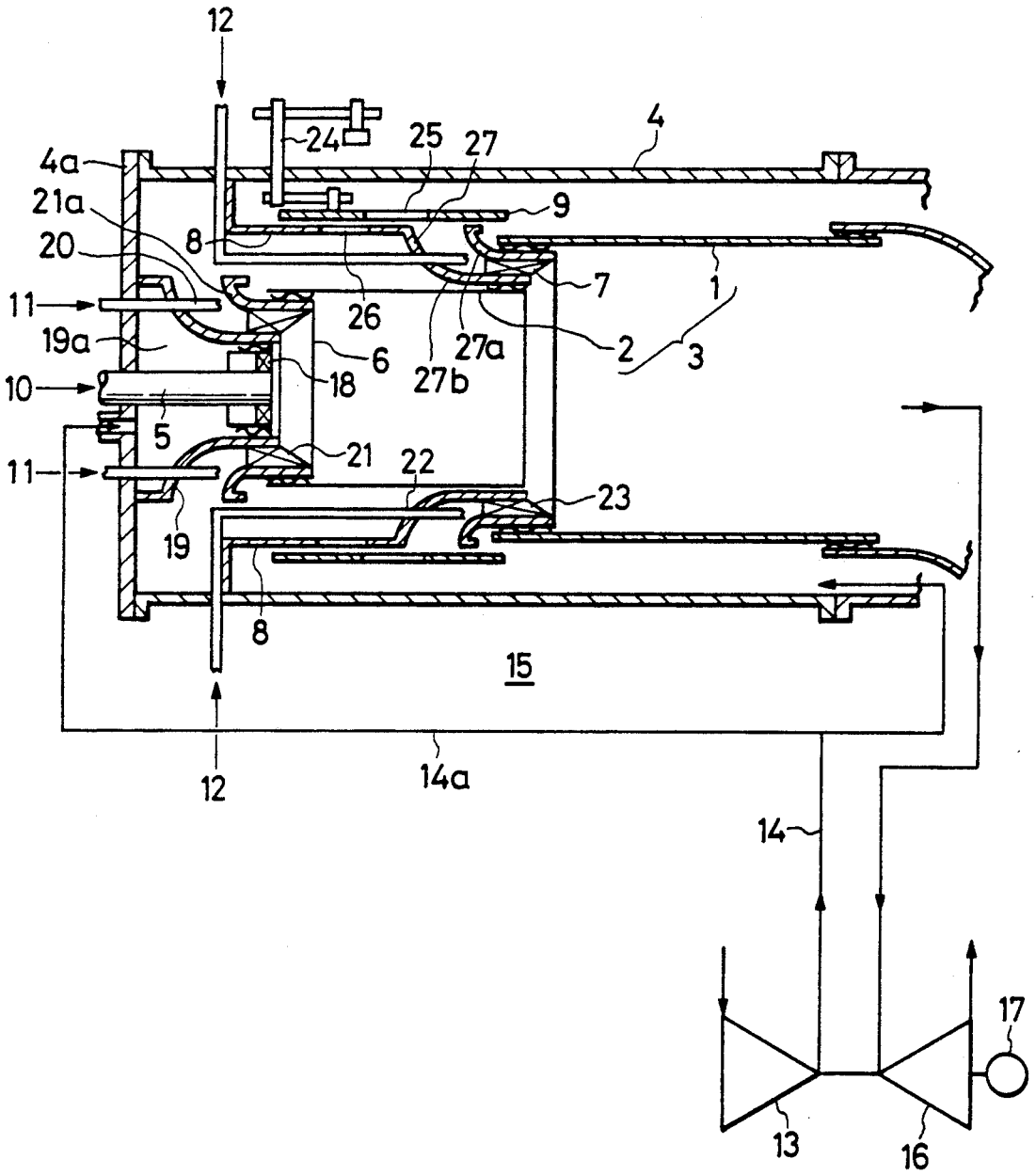
FIG. 1 is a sectional view of one embodiment of a turbine combustor according to the present invention.
Figure 4:
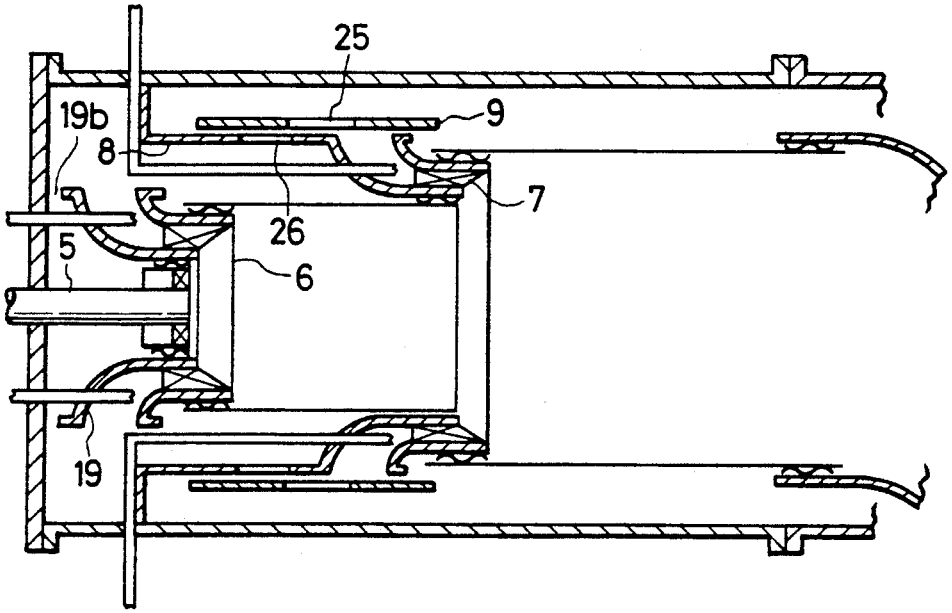
FIG. 4 is a sectional view of another embodiment of the turbine combustor according to the present invention.

FIG. 4 illustrates a modified example of the invention which differ from FIG. 1 in that a partition is not made completely by a pilot burner partition 19 so that a gap **19*b* is left, and the pilot burner 5 communicates with the first stage burner 6 in air passage. The combustion air passes through the air supply ports 25 of the guide ring 9 and the partition air introduction holes 26 of the partition 8 and is supplied into the pilot burner 5 and the first stage burner 6. In this case, the air flow rates of both of the burners 6, 7 are simultaneously controlled, but the same effect can be expected in the sense that the fuel-air ratio of the first stage burner 6 is suitably controlled. The second stage burner 7, and its control and other construction are the same as in FIG. 1**.

Other modified examples include an example where the portion of the pilot burner 5 is replaced by other premixing type burner or an example where the pilot burner 5 is completely removed. In these cases, unstability of premix combustion cannot be covered by other flames but this problem can be solved by setting the fuel-air ratio of the premix combustion flame to a little high value to insure stable combustion. In this sense, these modified examples are expected to exhibit substantially the same effect.

Figure 5:
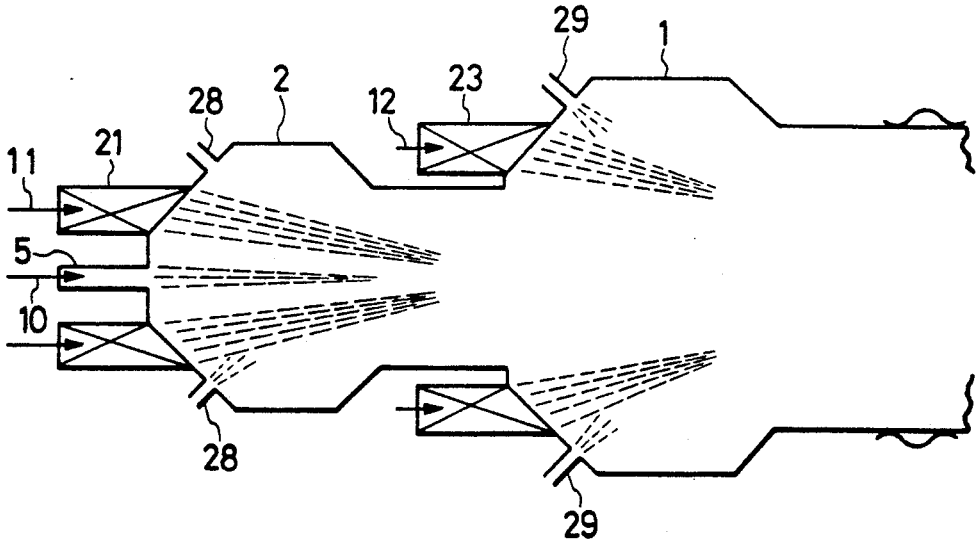
FIGS. 5 and 6 each are schematic views respectively showing other embodiments of the present invention.

FIG. 5 shows another modified construction wherein a single or a plurality of pilot burners 28 for the first stage burner 6 and pilot burners 29 for the second stage burner 7 are provided. Accordingly, the apparatus has somewhat thick main chamber 1 and sub-chamber 2 but exhibits good stability of flame.

Figure 6:
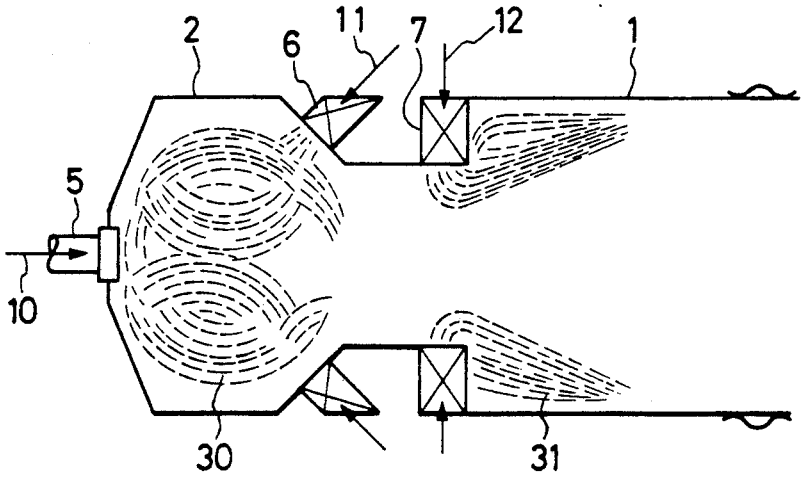

In FIG. 6 the first stage burner 6 is disposed in such a manner as to face the pilot burner 5 and the first stage flame 30 is generated as a stable eddy flame inside the sub-chamber 2. Further, the second stage burner 7 sprays the fuel in the radial direction to form second stage flame 31. In this manner, a two-stage combustor is formed which generates the stable flames for both of the burners 6, 7.

Though the embodiment and examples given above all deal with second-stage premix combustion by way of example, the same effect can be expected in the case of multi-stage premixing wherein the number of stage is further increased and such multi-stage premix combustion is also embraced in the scope of the present invention.

In accordance with the present invention, it becomes possible to enlarge the load range of premix combustion, to control both of the fuel and air in the respective combustion portions, to control suitably the fuel-air ratio, to reduce $NO_x$ and thus to accomplish low $NO_x$ concentration.

What is claimed is:

1. A multistage combustion type gas turbine combustor comprising a head combustion chamber means disposed at a head of said combustor for effecting first stage premix combustion of fuel premixed with combustion air, a first stage burner disposed at an upstream side of said head combustion chamber means and including a swirler and a fuel nozzle having a tip disposed upstream of a fuel-air mixture outlet of said swirler for introducing premixed fuel and air into said head combustion chamber means, a rear combustion chamber means connected to a downstream side of said head combustion chamber means for effecting second stage combustion of fuel premixed with combustion air, a second stage burner including a swirler, independent of said first stage burner and disposed downstream of said head combustion chamber means, for introducing the fuel air-mixture into said rear combustion chamber means, and means for regulating a flow rate of combustion air to be premixed with fuel and introduced into at least one of said head combustion chamber means and said rear combustion chamber means so as to form a suitable fuel and air premixture to effect premixed fuel combustion to thereby reduce $NO_x$ production, said means for regulating a flow rate of combustion air being disposed upstream of said swirlers thereby regulating a flow rate of combustion air.

2. A gas turbine combustor as defined in claim 1, wherein a means, independent of said first stage burner, is provided in said head combustion chamber means for producing a pilot combustion flame and stabilizing premix combustion flame generated in said head combustion chamber means.

3. A gas turbine combustor as defined in claim 1, wherein a plurality of pilot burners are provided in said head combustion chamber means and said rear combustion chamber means.

4. A gas turbine combustor as defined in claim 2, wherein said head combustion chamber means has a reduced cross-sectional area at a downstream side thereof, and a plurality of first stage burners are provided at said cross-sectional area portion to inject premixed fuel and air into a central portion of said head combustion chamber means.

5. A gas turbine combustor comprising:

a head combustion chamber means disposed at a head of said combustor for effecting first stage combustion, a first stage burner provided on an upstream side of said head combustion chamber means for introducing premixed fuel and air into said head combustion chamber means to effect a first stage premix combustion in said head combustion chamber means, said first stage burner having a swirler and a fuel nozzle including a tip disposed upstream of a fuel and air outlet of said swirler, a pilot burner provided adjacent to said first stage burner for a pilot combustion flame in said head combustion chamber means, a rear combustion chamber means connected to a downstream side of said head combustion chamber means for effecting second stage combustion, a second stage burner independent of said first stage burner and disposed at a downstream side of said head combustion chamber means and on an upstream side of said rear combustion chamber means for introducing premixed fuel and air into said rear combustion chamber means to effect a second stage premix combustion, and an air flow regulating means provided in said combustor to regulate a flow rate of first stage combustion air to be premixed with first stage fuel and a flow rate of second stage combustion air to be premixed with second stage fuel, thereby providing suitable fuel air premixture to effect lean combustion.

6. A gas turbine combustor as defined in claim 5, wherein said second stage burner is provided with a plurality of premixed fuel and air outlets arranged circumferentially of said rear combustion chamber means.

7. A gas turbine combustor as defined in claim 6, wherein said first stage burner is provided with a plurality of annularly arranged premixed fuel and air outlets, and said pilot burner is located at a center of said first stage burner, whereby premix combustion flame produced by said first stage burner is made stable by combustion flame produced by said pilot burner.

8. A gas turbine combustor comprising:

a combustor liner means for defining a cylindrical head combustion chamber means at a head of said combustor and a cylindrical rear combustion chamber means on a downstream side of said head combustion chamber means, said rear combustion chamber means having a larger diameter than said head combustion chamber means;

an axially elongated outer casing surrounding said combustor liner means with a space therebetween for defining an air passage;

a first stage burner disposed at an upstream side of said head combustion chamber means and having a swirler with annularly arranged outlets for premixed fuel and air and a fuel nozzle having a tip disposed upstream of said outlets for mixing fuel therefrom with air at an upstream side of said outlets to provide the premixed fuel and air;

a pilot burner disposed adjacent to said first stage burner for producing a combustion flame;

a second stage burner independent of said first stage burner and having a swirler with annularly arranged outlets for premixed fuel and air, said outlets being disposed between an outer surface of a downstream end portion of said head combustion chamber means and an inner surface of an upstream end portion of said rear combustion chamber means; and a combustion air flow regulating means at an upstream side of said swirlers for regulating a flow rate of combustion air to be led to said first stage burner from said space and a flow rate of combustion air to be led to said second stage burner from said space.

9. A gas turbine combustor as defined in claim 8, wherein said combustion air flow regulating means comprises a guide ring having a plurality of air holes each communicating with said first and second stage burners to introduce combustion air, and a mechanism for axially sliding said guide ring so that opening areas of said air holes opening to each of said first and second stage burners are selectively changeable.

10. A gas turbine combustor as defined in claim 8, wherein said pilot burner has combustion air supply passages independent of said space defining said air passage.

11. A combustion method for a gas turbine combustor comprising a head combustion chamber for effecting first stage combustion and a rear combustion chamber for effecting second stage combustion, said method comprising the steps of:

premixing first stage fuel with combustion air;

swirling and supplying the resultant first stage fuel air premixture into said head combustion chamber;

regulating a flow rate of the combustion air to be premixed with the first stage fuel before swirling so that the first stage fuel air premixture will be suitable to effect lean premix combustion;

firing and combusting the first stage fuel air premixture in said head combustion chamber when the turbine is in a low load operation;

premixing second stage fuel with combustion air;

swirling and supplying the resultant second stage fuel-air premixture into the rear combustion chamber in a downstream region of said head combustion chamber when the turbine reaches a high load operation, the second stage fuel air premixture being fired by a premixed first stage fuel combustion flame, and combusted in addition to the premixed first stage fuel combustion; and regulating a flow rate of the combustion air to be premixed with the second stage fuel so as to provide a fuel-air ratio to effect lean premixed combustion.

12. A combustion method for a gas turbine combustor comprising a head combustion chamber for effecting first stage combustion and a rear combustion chamber for effecting second stage combustion, said method comprising the steps of;

supplying fuel and air into said head combustion chamber and mixing said fuel and air in said head combustion chamber;

igniting and effecting a diffusion combustion of the fuel and air mixture to thereby form a pilot flame;

supplying first stage fuel into a first stage burner provided in said head combustion chamber;

supplying combustion air to said first stage nozzle to premix the combustion air with the first stage fuel while regulating a flow rate thereof so as to increase the flow rate with an increasing first stage fuel amount at an initial stage and then to provide a fuel-air premixture to effect lean premix combustion;

supplying and swirling the premixed first stage fuel and air into said head combustion chamber;

firing the premixed first stage fuel and air by the pilot flame to combust the first stage fuel and air at an initial and a low load operation of the turbine;

supplying second stage fuel to a second stage burner provided in said rear combustion chamber;

supplying combustion air to said second stage burner to premix the second stage burner combustion air with the second stage fuel while regulating a flow rate thereof so as to increase the second stage burner combustion air with an increasing of second stage fuel and to provide a fuel-air premixture to effect lean premixed combustion; and supplying, independently of the premixed first fuel and air, the premixed second stage fuel and air into said rear combustion chamber, the premixed second stage fuel and air being fired by the first stage premixed fuel combustion flame and combusted therein thereby effecting premixed combustion in addition to the first stage combustion when the turbine is in a high load operation.

13. A multistage combustion type gas turbine combustor comprising:

a head premix combustion chamber at a head of said combustor for effecting a first stage premix combustion of fuel premixed with combustion air during a load operation;

a first premixing means for premixing fuel and air and for injecting the premixed fuel and air into said head combustion chamber to effect a premix combustion, said first premixing means having a swirler through which the premixed fuel and air is injected;

a rear premix combustion chamber, connected to a downstream side of said head premix combustion chamber, for effecting second stage premix combustion during middle and high load operation of the turbine;

a second premixing means independent of said first premixing means for premixing fuel and air and for injecting the premixed fuel and air into said rear premix combustion chamber to effect premix combustion, said second premixing means being axially separated from said first premixing means; and first flow rate regulator means disposed at an upstream side of said swirler for regulating a flow rate of air directed to said first means so that a mixing ratio of fuel and air premixed by said first premixing means is suitable to achieve a lean premix combustion to thereby reduce $NO_x$ emission.

14. A multistage combustion type gas turbine combustion according to claim 13, wherein said combustor further includes a second flow rate regulator means for regulating a flow rate of air directed to said second premixing means so that a mixing ratio of fuel and air premixed by said second premixing means is suitable to achieve a lean premix combustion to thereby reduce $NO_x$ emission, and means for simultaneously operating said first and second regulator means.

15. A gas turbine combustor according to claim 14, wherein a means are provided at an upstream side of said head combustion chamber for producing pilot diffusion combustion flame to stabilize a premix combustion flame produced in said head combustion chamber so that a lean premix combustion stabilized by the pilot diffusion combustion flame is effected.

16. A multistage combustion type gas turbine combustor as according to claim 15, wherein said first premixing means comprises an outer annular partition, an inner annular partition coaxially disposed in said outer annular partition with an annular space therebetween, and a plurality of swirler vanes arranged in said annular space to provide a plurality of outlets for premixed fuel and air along an inner circumference of said head premix combustion chamber, whereby premixed fuel and air are whirled and supplied into said head premix combustion chamber to be combusted therein.

17. A multistage combustion type gas turbine combustor according to claim 16, wherein said means for producing pilot diffusion combustion flame comprises a fuel nozzle, a plurality of swirler vanes mounted around said fuel nozzle, said fuel nozzle and said swirler vanes are disposed in said inner annular partition to fire the premixed fuel and air supplied by said first means into said head premix combustion chamber and stabilize the premix combustion flame.

18. A multistage combustion type gas turbine combustor, according to claim 13, wherein said head premix combustion chamber includes a first cylindrical liner for defining said head premix combustion chamber, said rear premix combustion chamber including a second cylindrical liner for defining said rear premix combustion chamber, said second cylindrical liner having a larger diameter than a diameter of said first cylindrical liner, and said second means axially slidably disposed in an annular space formed between said first and second cylindrical liners.

19. A multistage combustion type gas turbine combustor according to claim 18, wherein said second premixing means comprises an outer annular member inserted in and slidable on said second cylindrical liner, an inner annular member disposed in said outer annular member with an annular space therebetween, and a plurality of swirler vanes in said annular space, said first cylindrical liner being slidably inserted in said inner annular member.

20. A multistage combustion type gas turbine combustor according to claim 13, wherein said first premixing means comprises a plurality of swirler vanes arranged in a annular form to provide a plurality of outlets along an inner circumference of said head premix combustion chamber so that premixed fuel and air is introduced into said head combustion chamber while swirling, and a pilot burner is provided so as to be surrounded by said plurality of outlets, a fuel nozzle and a plurality of swirler vanes mounted on a surrounding said fuel nozzle.

21. A combustion method for a gas turbine combustor, the method comprising the steps of:

providing a head combustion chamber means at a head of said combustor for effecting a first stage premix combustion of fuel premixed with combustion air, providing a first stage burner having a swirler and fuel nozzle, locating a tip of the fuel nozzle upstream of a fuel-air mixture outlet of said swirler, connecting a rear combustion chamber means to a downstream side of said head combustion chamber means for effecting second stage combustion of fuel premixed with combustion air, providing a second stage burner including a swirler, independent of said first stage burner and disposed downstream of said head combustion chamber means, for introducing the fuel air mixture into said rear combustion chamber means, and regulating a flow rate of combustion air to be premixed with fuel and introduced into at least one of said head combustion chamber means and said rear combustion chamber means so as to form a suitable fuel and air premixture to effect premixed fuel combustion to thereby reduce $NO_x$ combustion.

22. A combustion method according to claim 21, further comprising the step of:

producing a pilot combustion flame and stabilizing a premix combustion flame generated in said head combustion chamber means.

23. A combustion method for a gas turbine combustor, the method comprising the steps of:

providing a head combustion chamber means at a head of said combustor for effecting a first stage combustion providing a first stage burner including a swirler and fuel nozzle, locating a tip of the fuel nozzle upstream of a fuel-air mixture outlet of said swirler, for introducing premixed fuel and air into said head combustion chamber means to effect a first stage premix combustion, producing a pilot combustion flame in said head combustion chamber means by a pilot burner provided adjacent to said first stage burner, connecting a rear combustion chamber means to a downstream side of said head combustion chamber means for effecting second stage combustion, introducing premixed fuel and air into said rear combustion chamber means to effect a second stage premix through a second stage burner, independent of said first stage burner, disposed on an upstream side of said rear combustion chamber means, and regulating an air flow in said combustor to regulate a flow rate of the first stage combustion air to be premixed with the first stage fuel and a flow rate of the second stage combustion air to be premixed with the second stage fuel so as to provide a suitable fuel air premixture to effect lean combustion.

* * * * *